United States Patent [19]

Thomas et al.

[11] Patent Number: 4,507,183

[45] Date of Patent: Mar. 26, 1985

[54] RUTHENIUM COATED ELECTRODES

[75] Inventors: Robert C. Thomas; Robert D. Caldwell; Douglas E. Doner, all of Midland, Mich.

[73] Assignee: The Dow Chemical Company, Midland, Mich.

[21] Appl. No.: 500,687

[22] Filed: Jun. 3, 1983

[51] Int. Cl.[3] ..... C25B 1/14

[52] U.S. Cl. ..... 204/98; 204/47; 204/128; 204/290 R

[58] Field of Search ..... 204/290 R, 98, 128, 204/252

[56] References Cited

U.S. PATENT DOCUMENTS

| | | | |
|---|---|---|---|
| 4,112,140 | 9/1978 | Heikel | 204/290 F |
| 4,142,950 | 3/1979 | Creamer | 204/96 |
| 4,190,516 | 2/1980 | Kajimaya | 204/290 R |
| 4,297,178 | 10/1981 | Crosby | 204/47 |
| 4,300,992 | 11/1981 | Yoshida | 204/290 F |

*Primary Examiner*—John F. Niebling

*Attorney, Agent, or Firm*—Joe R. Prieto

[57] ABSTRACT

An electrode produced by electroplating ruthenium metal on a substrate from a nonacidic ruthenium-containing electroplating solution.

21 Claims, No Drawings

RUTHENIUM COATED ELECTRODES

BACKGROUND OF THE INVENTION

This invention relates to electrodes and, more particularly, to ruthenium coated electrodes and a method for manufacturing such electrodes.

Electrodes, in general, are used in a variety of different processes such as electrolytic processes, electrowinning of metals, cathodic protection, etc. In an electrolytic process, such as for the production of halogen and alkali metal hydroxide, so-called low overvoltage electrodes are employed in electrolytic cells to reduce some of the large amounts of energy consumed during the cell's operation. It is well known to manufacture low overvoltage electrodes by coating an electroconductive substrate, such as titanium, nickel, iron, or steel, or with an electrolytically-active material, for example, a platinum group metal or oxides thereof, or alloys thereof. A "platinum group metal" refers to one of the metals of platinum, iridium, ruthenium, rhodium, osmium, palladium, or alloys thereof. Common coating methods used to produce low overvoltage electrodes are, for example, plasma or flame spraying, electrodeposition, and electroless or chemical deposition.

Low overvoltage electrodes, anodes or cathodes, are typically coated with a ruthenium metal surface by an electrodeposition method. For example, U.S. Pat. No. 3,578,572 describes a method for electroplating a platinum metal, such as ruthenium, onto a titanium support and using this platinum metal coated support as an electrode, particularly an anode, in aqueous alkali metal chloride electrolytes. Also, U.S. Pat. No. 3,974,058 specifically describes electroplating ruthenium on a metal substrate with an intermediate coating of cobalt for use as a cathode in electrolytic cells.

In the above methods, however, the ruthenium electroplating baths used to plate the metal on a substrate are acidic. In an acidic environment displacement plating may occur. Thus, many metallic substrates, such as copper, nickel, or steel, cannot be satisfactorily plated with ruthenium in acidic solutions without first applying a protective "flash" coating of a suitable metal, such as gold or other suitable metals to the substrate.

It is desired to provide a ruthenium coated electrode and method for making the electrode which reduces the displacement plating experienced using existing methods.

SUMMARY OF THE INVENTION

The present invention is an electrode comprising a substrate having at least a working portion electroplated with a ruthenium metal deposited from a nonacidic ruthenium-containing solution. Also disclosed is a method of producing the ruthenium coated electrode by electroplating a substrate with ruthenium metal deposited from a nonacidic ruthenium-containing solution. An electrode coated with ruthenium by the above method can be used as a cathode in an electrolytic cell for producing, for example, a halogen and an alkali metal hydroxide.

DESCRIPTION OF THE PREFERRED EMBODIMENTS

According to the present invention, a ruthenium coated electrode is produced by electrodepositing an adherent ruthenium metal coating onto at least a portion of a substrate. The electrodeposited ruthenium metal coating is characterized in that it is electrodeposited from a nonacidic ruthenium-containing electroplating solution.

The substrate can be any desired shape, size or geometry and of any material compatible with the ruthenium-containing solution. The substrate, however, should be conductive to be useful as an electrode. The electrode of the present invention can be an anode or cathode, more preferably a cathode. Hereinafter the electrode will be referred to as a cathode. However, it is to be understood that the present invention is not limited to a cathode.

The cathode can be, for example, a solid metal, a perforated or expanded metal sheet, a screen or mesh where the metal is, for example, iron, steel, nickel, or copper or alloys thereof. Preferably, the cathode is an uncoated ferrous metal, such as steel, because of its availability and relatively low cost. However, within the scope of the invention, the cathode may first be coated with any desired thickness of a suitable metal base, such as nickel, by any known method, for example, electrodeposition from a conventional plating bath.

The electroplating solution or bath used for producing the cathode according to the present invention is a neutral or alkaline solution containing ruthenium. The preferred nonacidic electroplating solution or bath is described in U.S. Pat. No. 4,297,178, the teachings of which are incorporated by reference. The source of ruthenium contained in the electroplating solution is a dissolved reaction product of (1) a compound or complex that contains a nitrogen bridge linkage joining together two ruthenium atoms and (2) an acid or an anion of such acid in an aqueous solution. The ruthenium compound may be a salt of the complex $[Ru_2N(H_2O)_2X_8]^{3-}$ where each X represents a chlorine or bromine atom. For example, the potassium salt $K_3[Ru_2N(H_2O)_2Cl_8]$. The acid may be a difunctional aliphatic acid, for example, oxalic or malonic acid and the anion of such acids may be an oxalate or a malonate in aqueous solution. The electroplating solution preferably contains a concentration of about 5 to about 20 grams per liter (g/l) of $K_3[Ru_2N(H_2O)_2Cl_8]$, a product available commercially from International Nickel Company, and about 20 to about 80 g/l of oxalic acid in an aqueous solution.

It is important to keep the electroplating solution nonacidic or at a neutral or alkaline pH. It is preferable to keep the pH value of the solution at about 7 to about 10. This assures an adherent coating of ruthenium on a substrate, for example, steel, which tends to corrode in an acidic environment. Initially, in preparing the electroplating solution, the reaction between the ruthenium compound and acid may be carried out under acidic conditions. The pH may then be adjusted to a nonacidic value by use of a suitable base such as potassium hydroxide.

As an exemplification of the present invention, the electroplating solution above can be used to coat ruthenium on a substrate which is subsequently placed, as a cathode, in an electrolytic cell. For example, the substrate is first positioned as a cathode in the electroplating bath to plate ruthenium onto the substrate. The plating is preferably performed at cathode current densities of about 100 to about 1000 amps per square meter (ASM), and preferred temperatures of about 40° to about 80° C. The amount of ruthenium deposited onto the cathode can be any desired amount. It is preferred to deposite about 50 to about 1000 micrograms of ruthenium per square centimeter ($\mu g/cm^2$) of cathode surface area on the cathode to provide an effective catalytic surface of ruthenium on the cathode. As little as a monolayer of ruthenium may be deposited onto the cathode. However, it is relatively difficult to obtain a uniform monolayer onto a cathode surface. The larger amounts of ruthenium, i.e., above 1000 $\mu g/cm^2$, are at this time only limited by the cost of the ruthenium material. The coating can be applied to a working portion of the cathode or substantially the entire surface of the cathode. The working portion of the cathode means the portion of the cathode in actual contact with an electrolyte.

The cathode coated with ruthenium by the above method can be used in several electrolytic processes such as electrolysis, electrowinning of metals, and cathodic protection. Although not limited to a particular electrolyic process the ruthenium coated cathode may be used in the electrolysis of alkali metal halides for the production of alkali metal chlorates or for the production of halogens and alkali metal hydroxides. As an illustration only and not to limit the scope of the present invention, the cathode is placed in an electrolytic cell used for the electrolysis of a sodium chloride or brine solution. Electrolysis of the sodium chloride solution in an electrolytic cell having no separator between the anode and cathode results in the production of sodium chlorates. Electrolysis of the sodium chloride solution in an electrolytic cell having a separator results in the production of chlorine and sodium hydroxide. In both cells hydrogen is generated at the cathode. The type of cell used will depend on the desired electrolysis. Hereinafter, for purposes of illustration only, reference will be made to the electrolysis of brine to produce chlorine and sodium hydroxide in an electrolytic cell having a separator between the anode and cathode of the cell (chlor-alkali cell). The chlor-alkali cell preferably contains as a separator between the anode and the cathode, an ion and liquid pervious diaphragm, such as asbestos or polytetrafluoroethylene materials known in the art, or substantially liquid impervious ion exchange membrane, such as a perfluorosulfonic acid ion exchange membrane sold under the trademark Nafion® (a duPont trademark) or ion exchange membranes based on perfluorocarboxylic acid.

The ruthenium coated cathode exhibits a low hydrogen overvoltage when installed in chlor-alkali cells which results in a savings in operating cell voltage. For example, when a piece of low carbon steel is coated with ruthenium and installed as a cathode in the chlor-alkali cell, an electric current voltage savings in the cell on the order of about 0.10 to about 0.25 volt to about 770 ASM can be realized as compared to using an uncoated steel cathode in the same cell. This amounts to a savings of power in the operation of certain cells of about 3 to about 8 percent. Even a 1 percent savings in the operation of commercial chlor-alkali cells may be substantial.

As another exemplification of the present invention, the chlor-alkali cell cathode can be coated with ruthenium in situ in the chlor-alkali cell utilizing an aqueous solution containing the reaction product of the complex $[Ru_2N(H_2O)_2X_8]^{3-}$ where X is chlorine or bromine and an aliphatic difunctional acid or the anion of such an acid in aqueous solution. An example of an aliphatic difunctional acid is oxalic or malonic acid and an example of an anion of an aliphatic difunctional acid is an oxalate or malonate ion. The ruthenium compound and the acid or anion in aqueous solution can be added to the catholyte of the chlor-alkali cell while the cell is energized. The ruthenium is deposited onto a working portion of the cathode while the cell is in operation.

The following examples further illustrate the invention.

EXAMPLE 1

A ruthenium coated cathode was prepared as follows: a 100 millimeter (mm) by 100 mm by 2.3 mm punched hole steel plate was cleaned by sandblasting the surface with aluminum oxide, a method well known in the art of cleaning metals. The steel plate was further cleaned by immersing and positioning the plate as an anode in an acid bath containing 630 milliliters (ml) of demineralized water, 450 ml of concentrated sulfuric acid, and 1920 ml of concentrated phosphoric acid and passing a direct current of about 4 amps at 25° C. for 6 minutes from the plate to a platinum foil cathode also immersed in the bath. This method is also well known in the art of cleaning metals.

The cleaned steel plate was thereafter positioned as a cathode in an electrodeposition cell. The electrodeposition cell was a compartmented cell with a cathode compartment with catholyte, an anode compartment with anolyte, and an anode. The anode and cathode compartments where separated by Nafion® 324, a perfluorosulfonic acid ion exchange membrane manufacture by duPont. The catholyte of the electrodeposition cell was prepared by dissolving 20 grams of $K_3[Ru_2N(H_2O)_2Cl_8]$ and 80 grams of oxalic acid in 600 ml of demineralized water. This solution was neutralized to a pH of 7 with 30% KOH and then diluted to one liter (1) with demineralized water. The anolyte of the electrodeposition cell was prepared by mixing 1 gram of oxlic acid in one liter of demineralized water. The electrodeposition of ruthenium onto the steel plate was carried out at a current of 2 amps for 120 seconds with the bath temperature at 60° C. About 286 $\mu g/cm^2$ of ruthenium was deposited on the cathode surface as measured by X-ray fluorescence analysis.

The ruthenium coated steel plate electroplated by the method above was placed in a laboratory chlor-alkali cell as a cathode. The chlor-alkali cell consisted of two machined polytetrafluoroethylene (PTFE) halves, one for the anode and one for the cathode. The anode was 89 millimeters (mm)×89 mm×1.6 mm flat plate made of titanium covered with a ruthenium-titanium oxide coating. The separator used in the cells was a crysotile asbestos diaphragm deposited on the cathode surface by methods well known in the art. A rubber gasket with an 89 mm×89 mm square opening was positioned between the two PTFE halves. Stainless steel bolts were used to hold the cell together. A quartz resistance heater and a glass sheathed resistance temperature device (RTD) were used to control the temperature in the anolyte compartment. Saturated sodium chloride brine was fed into the anode compartment of the cell with chlorine collected under a slight suction at the top of the anode compartment. A brine flow of about 1 to 2 milliliters per minute (ml/min) was achieved by controlling the brine head on the anode side of the cell at several inches above the top of the cell. Sodium hydroxide and sodium chloride effluent flowed out of the cathode compartment while hydrogen was vented out the top of the cathode compartment. The sodium hydroxide strength as shown in Table I (in g NaOH/liter) was controlled by the electrode current density and the brine flow through the diaphragm into the cathode chamber. Luggin probes, consisting of ⅛ inch O.D. PTFE tubing, from a small reservoir containing a saturated calomel reference electrode (SCE) were placed at the back surface of both chlor-alkali electrodes to measure the half-cell potential of the cathode and anode during cell operation. The cell was operated for 61 days at about 80° C. and 775 ASM. The results are described in Table I below.

TABLE I

| Day | Total Cell Volts | Cathode Half Cell Potential vs SCE (millivolts) | Catholyte (g NaOH/l) |
|---|---|---|---|
| 0 | 2.67 | −1107 | 21 |
| 2 | 2.83 | −1210 | 80 |
| 7 | 2.85 | −1265 | 67 |
| 16 | 3.00 | −1449 | 97 |
| 29 | 3.02 | −1493 | 120 |
| 48 | 3.03 | −1516 | 107 |
| 61 | 3.02 | −1508 | 103 |

EXAMPLES 2–4

In situ Plating of Ruthenium on Cathode

Several small laboratory electrolytic cells were used to test cathodes coated with ruthenium in situ. All cells were identical to the chlor-alkali cell in Example 1 except that the cells contained the cathode as described in Table II, below. The half cell potential of the cathodes described in Table II was measured at 80° C. and 6 amperes current. An aqueous solution containing about 0.069 gram of $K_3[Ru_2N(H_2O)_2Cl_8]$ and about 0.29 gram of oxalic acid in 10 ml of demineralized water was slowly added to each of the cell's catholyte compartments through the Luggin probe. Ruthenium metal electroplated onto the cathode member as the cells were energized. The amount of ruthenium deposited onto the cathode of Cell A was measured using x-ray fluorescence. The front of the cathode, i.e., the position of the cathode facing the anode, contained 78 $\mu g/cm^2$ ruthenium while the back of the cathode, i.e., the portion of the cathode facing opposite the anode contained 111 $\mu g/cm^2$. The amount of ruthenium on the cathodes of Cell B and C were not measured.

TABLE II

| Cell | Cathode Substrate | Ruthenium Deposited on Cathode ($\mu g/cm^2$) | Cathode Half Cell Potential Versus SCE (MV) 0 Day | ½ Hour | 1 Day | 6 to 7 Days | 12 to 14 Days | 41 to 43 Days |
|---|---|---|---|---|---|---|---|---|
| A | nickel | front = 78 back = 111 average per side = 95 | −1453 | −1116 | −1136 | −1170 | −1293 | — |
| B | porous nickel on steel | — | −1243 | −1120 | −1127 | −1145 | −1153 | −1188 |
| C | steel | — | −1395 | −1136 | −1184 | −1277 | −1289 | — |

The cathode half cell potentials in the cells described in Table II increased at varying rates with time. This is believed to be due to "trash materials" or impurities present in the brine feed or cell components which may build up on the surface of the ruthenium coating. Analysis of the ruthenium surface using Auger microanalysis showed that the surface was covered with trash materials, primarily calcium, magnesium, iron, lead and chromium after the cell was in operation several days. On the other hand, analysis of the cathodes by X-ray fluorescence showed little, if any, ruthenium loss.

The foregoing specification is written for the purpose of illustration and not limitation. It will be apparent to one of ordinary skill in the art that there are many other modifications and variations to the present invention without departing from the spirit and scope of this invention. Such modifications and variations are considered to be within the scope of this invention and appended claims.

What is claimed is:

1. A method comprising:

(a) electroplating a ruthenium metal onto at least a working portion of a cathode adapted to be used in an electrolytic cell with an anode, a cathode, a separator in between the anode and cathode, adapted to permit alkali metal ions to be transported therethrough from the anode to the cathode, said cathode electroplated with a nonacidic ruthenium-containing solution including a dissolved reaction product of:

(i) a salt of the complex $[Ru_2N(H_2O)_2X_8]^{3-}$ where X represents either a chlorine or a bromine, and (ii) an acid or the anion of such acid in aqueous solution and an electrolyte;

(b) installing said cathode in the electrolytic cell, and (c) passing a direct current from the anode to the cathode such that a halogen and an alkali metal hydroxide is produced.

2. The method of claim 1 wherein the acid is an aliphatic difunctional acid or the anion of such acid is an anion of an aliphatic difunctional acid in aqueous solution.

3. The method of claim 2 wherein the acid is malonic or oxalic or the anion is a malonate or an oxalate in aqueous solution.

4. The method of claim 3 wherein the salt of the complex $[Ru_2N(H_2O)_2X_8]^{3-}$ is $K_3[Ru_2N(H_2O)_2Cl_8]$ and the acid is an oxalic acid or the anion is an oxalate in aqueous solution.

5. The method of claim 4 wherein the cathode is electroplated at a pH of about 7 to about 10.

6. The method of claim 4 wherein $K_3[RuNCl_8(H_2O)_2]$ is added in the amount of about 5 to about 20 g/l.

7. The method of claim 6 wherein oxalic acid is added in the amount of about 20 to about 80 g/l.

8. A method comprising:

(a) electroplating a ruthenium metal onto at least a working portion of a cathode adapted to be used in an electrolytic cell with an anode, a cathode, said cathode electroplated with a nonacidic ruthenium containing solution including a dissolved reaction product of:

(i) a salt of the complex $[Ru_2N(H_2O)_2X_8]^{3-}$ where X represents either a chlorine or a bromine, and
(ii) an acid or the anion of such acid in aqueous solution, and an electrolyte;

(b) installing said cathode in the electrolytic cell, and
(c) passing a direct current from the anode to the cathode such that an alkali metal chlorate is produced.

9. The method of claim 8 wherein the acid is an aliphatic difunctional acid or the anion of such acid is an anion of an aliphatic difunctional acid in aqueous solution.

10. The method of claim 9 wherein the acid is malonic acid or oxalic or the anion is a malonate or an oxalate in aqueous solution.

11. The method of claim 10 wherein the salt of the complex $[Ru_2N(H_2O)_2X_8]^{3-}$ is $K_3[Ru_2N(H_2O)_2Cl_8]$ and the acid is an oxalic acid or the anion is an oxalate in aqueous solution.

12. The method of claim 11 wherein the cathode is electroplated at a pH of about 7 to about 10.

13. The method of claim 11 wherein $K_3[Ru_2N(H_2O)_2Cl_8]$ is added in the amount of about 5 to about 20 g/l.

14. The method of claim 13 wherein oxalic acid is added in the amount of about 20 to about 80 g/l.

15. A method comprising:

(a) introducing (i) a salt of the complex $[Ru_2N(H_2O)_2X_8]^{3-}$ where X represents either a chlorine or a bromine, and (ii) an acid or an anion of said acid in aqueous solution into an electrolytic cell with an anode, an anolyte solution, a cathode, a catholyte solution and a separator in between the anode and cathode, adapted to permit alkali metal ions to be transported therethrough from the anode to the cathode, and
(b) passing a direct current from the anode to the cathode such that the ruthenium metal is plated onto the cathode and a halogen and an alkali metal hydroxide is produced in the cell.

16. The method of claim 15 wherein the acid is an aliphatic difunctional acid or the anion of such acid is an anion of an aliphatic difunctional acid in aqueous solution.

17. The method of claim 16 wherein the acid is malonic or oxalic or the anion is a malonate or an oxalate in aqueous solution.

18. The method of claim 17 wherein the salt of the complex $[Ru_2N(H_2O)_2X_8]^{3-}$ is $K_3[Ru_2N(H_2O)_2Cl_8]$ and the acid is an oxalic acid or the anion is an oxalate in aqueous solution.

19. The method of claim 18 wherein the cathode is electroplated at a pH of about 7 to about 10.

20. The method of claim 19 wherein $K_3[Ru_2N(H_2O)_2Cl_8]$ is added in the amount of about 5 to about 20 grams per liter.

21. The method of claim 20 wherein oxalic acid is added in the amount of about 20 to about 80 grams per liter.

* * * * *